United States Patent [19]

Frankel

[11] Patent Number: 4,626,247

[45] Date of Patent: Dec. 2, 1986

[54] SWEAT COLLECTING HEADBAND

[76] Inventor: Alfred R. Frankel, 403 Gulf Way - Apt. 701, Pass-A-Grille Beach, Fla. 33706

[21] Appl. No.: 572,121

[22] Filed: Jan. 19, 1984

Related U.S. Application Data

[63] Continuation-in-part of Ser. No. 343,411, Jan. 28, 1982, abandoned.

[51] Int. Cl.[4] ..... A61J 7/00; A42B 1/22

[52] U.S. Cl. ..... 604/312; 604/19; 2/181.8; 2/425

[58] Field of Search ..... 2/171.2, 171.3, 171.4, 2/171.5, 171.6, 171.7, 171.8, 181, 181.8, 200, 425, 452, 7, 174; 604/312, 317, 79, 77, 19; 128/136, 207.17, 207.18

[56] References Cited

U.S. PATENT DOCUMENTS

| | | | |
|---|---|---|---|
| 2,320,782 | 6/1943 | Larson | 2/171 |
| 3,319,262 | 5/1967 | Lee | 2/174 |
| 3,892;239 | 7/1975 | Masso Remiro | 604/312 |
| 4,170,230 | 10/1979 | Nelson | 128/136 |
| 4,190,060 | 2/1980 | Greenleaf et al. | 604/312 |
| 4,368,545 | 1/1983 | Seidman | 2/174 |
| 4,406,283 | 9/1983 | Bir | 128/207.18 |
| 4,481,680 | 11/1984 | Mason et al. | 2/171.2 |

*Primary Examiner*—John F. Niebling
*Assistant Examiner*—B. J. Boggs, Jr.
*Attorney, Agent, or Firm*—Walter J. Monacelli

[57] ABSTRACT

The device described herein comprises a sweatband adapted to collect sweat from the forehead of a runner or other exerciser and optionally to feed the collected sweat to a tube running down to the runner's mouth so that the salt and water given off in the sweat may be returned to the body. If it is not desired to return the sweat to the runner's mouth, it may be allowed to run off away from the runner's face. The sweatband has one or more grooved strips which have the open portion of the groove (or grooves) facing upward or toward the runner's forehead and adapted to collect sweat running down the forehead. The grooves may feed into a tube or groove which runs downward to a mouthpiece to be inserted into the runner's mouth and the sweat fed into the runner's mouth through an opening in the mouthpiece. The tube may have openings therein or actually comprise a groove slanted forward and downward on the face so that facial sweat may also be collected.

5 Claims, 9 Drawing Figures

SWEAT COLLECTING HEADBAND

This application is a continuation-in-part of application Ser. No. 343,411, filed Jan. 28, 1982, now abandoned.

BACKGROUND OF THE INVENTION

1. Field of the Invention

This invention relates to a specially designed sweatband adapted to collect sweat running down a runner's forehead and face and if desired to feed this sweat to a tube or groove passing downward to the runner's mouth. More specifically, this tube feeds into a mouthpiece which fits into the mouth and has an opening through which the collected sweat may pass into the mouth and thereby restore to the body salts contained in the sweat.

2. State of the Prior Art

Vigorous exercise is known to produce sweat or perspiration from various parts of the body. When the exercise, such as running, is prolonged, a considerable amount of sweat is produced. It is known that prolonged sweating, such as in cross-country or marathon running, results in the depletion of salt and water from the body. It is advisable to take electrolyte replacement solutions to compensate for this depletion. However when electrolyte replacement solutions are not available, it would appear more appropriate to return to the body the same salt and water contained in the sweat lost from the body.

Headbands have been used for various purposes such as to keep forehead sweat from running into the eyes, to exert pressure on the head to relieve headaches (U.S. Pat. No. 3,159,160), and to keep the head cool (U.S. Pat. No. 3,029,438). However, no references have been found for the collection of some of the sweat and returning it to the body to replenish some of the depleted salt and water.

SUMMARY OF THE INVENTION

In accordance with the present invention, a headband has been designed which is capable of collecting sweat from a runner's forehead and if desired, also from the runner's face and optionally feeding such sweat down a tube or groove to a mouthpiece through which the collected sweat may be returned to the body. This is particularly suitable for long distance or marathon runners to avoid the weakness which often results from the depletion of salt and water from the body because of sweating for a prolonged period. If so desired, the sweat may be allowed to run off away from the runner's face without being returned to the runner's mouth. The headband advantageously has one or more grooves facing upward and preferably toward the head so that as the sweat is stopped from running down the forehead by the snug fit of the headband against the forehead, the sweat will spill over into and collect in the groove. The groove may lead to a tube or groove slanted downward to a mouthpiece which the runner holds in his mouth. This mouthpiece has an opening through which the collected sweat is fed into the mouth.

It is also preferred to have the tube or tubes or grooves leading from the headband to the mouthpiece slanted forward from the runner's ear to the mouthpiece and fitted snugly against the face so as to keep sweat from running past this tube or groove and to direct sweat downward to the mouthpiece. If a tube is used for this purpose, it has slots positioned therein to allow sweat from the face to enter the tube. If a groove is used, this operates similarly to the groove in the headband so as to collect sweat and feed it downnward to the mouthpiece. It is contemplated also that the headband may comprise a tube instead of a groove with slots positioned in the tube to allow collected sweat to pass into the interior of the tube. Instead of slots such a tube may have openings of various sizes, from large openings to capillary openings for admission of the sweat to the interior of the tube.

In another modification the headband may comprise two or more grooved pieces fitting across the forehead and feeding into one tube or two tubes or even more tubes or grooves slanting downward to the mouthpiece. In still another modification the headband may be of considerable width (from top to bottom) with a number of open groove portions which may collect sweat and feed it, as described above, downward to the mouthpiece. The mouthpiece may be of hard material to withstand better clamping of teeth thereon or may be merely of the same tube material with an opening therein to allow the collected sweat to pass into the mouth.

The novel design of this invention may be illustrated by reference to the accompanying drawings in which.

DETAILED DESCRIPTION

Figure 1:
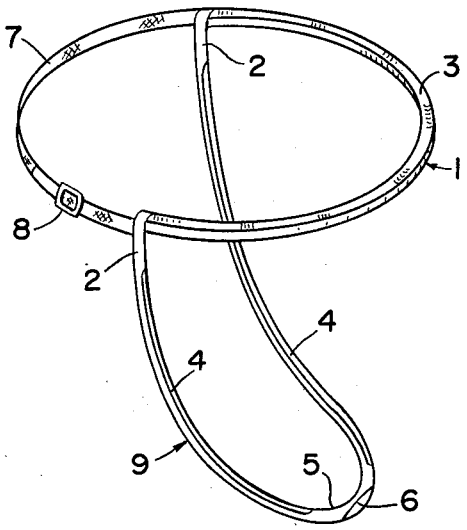
FIG. 1 is a perspective view of one modification of a headband of this invention having one collecting groove and a tube on each side of the head leading downward to a mouthpiece.

In these Figures, headband 1 has a groove, gutter or trough 3 which faces upward and is adapted to collect sweat running down the forehead. Groove or trough 3 has an opening communicating with and feeding into tube 2. Tube 2 has a groove or trough 4. Hollow tube 2 slants downward into faceband 9 which slants downward and forward from the ear region of the runner to the mouth area so that sweat running down the runner's face will run into trough 4 and be directed downward to mouthpiece 5 and out through opening 6. Elastic band 7 may be tightened by buckle 8 to give the headband 1 a tight fit against the forehead and faceband 9 a tight fit against the face. In place of faceband 9, tube 2 may extend all the way downward to the mouth.

Figure 2:
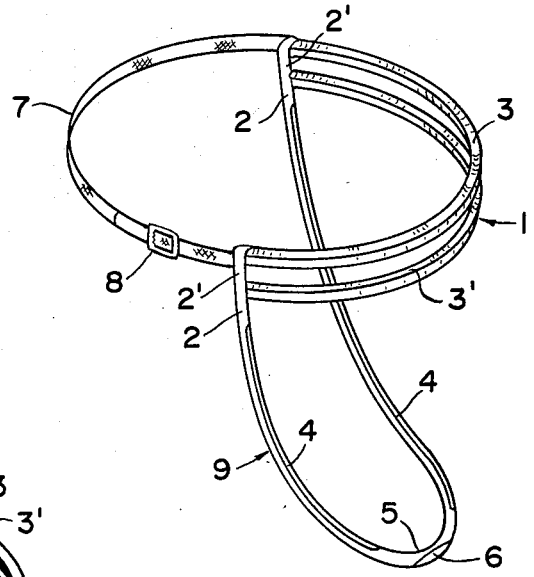
FIG. 2 is a perspective view of another modification of the invention in which two collecting grooves are adapted to be positioned on the forehead, both of which grooves feed into the downward tube or groove.

In FIG. 2 there are two headbands 1, each of which has a groove or trough, namely 3 and 3′ respectively. Trough 3 feeds into tube 2′ which in turn feeds into tube 2. Trough 3′ feeds directly into tube 2.

Figure 3:
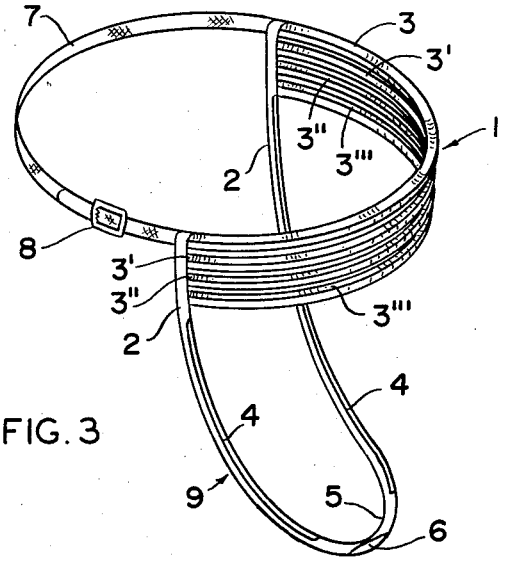
FIG. 3 shows a perspective view of another modification of this invention which comprises a wide headband having three or more collecting grooves which again feed into a tube or groove slanting downward to the mouthpiece.

In FIG. 3 there is a wide headband 1 which has a number of collecting troughs 3, 3′ and 3″ and 3‴, all of which feed into tube 2.

Figure 7:
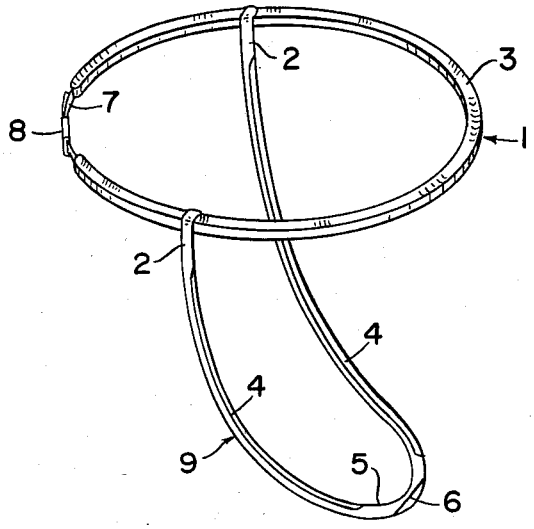
FIG. 7 is a perspective view of a modification of a headband having the collecting groove extending around to the back of the head.
Figure 8:
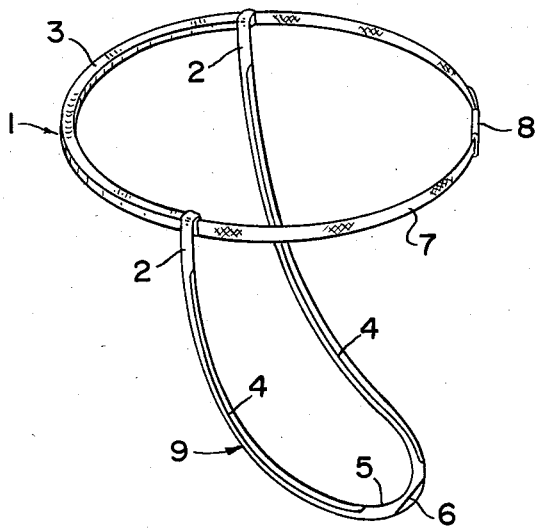
FIG. 8 is a perspective view of a modification of the invention in which the collecting groove extends only on the back of the head.

While the foregoing description is directed to headbands collecting sweat from the forehead, it is also intended that the headband may be modified to collect sweat from the back of the head as shown in FIG. 8 instead of or in addition to collecting from the forehead as shown in FIG. 7. In such case the headband portion collecting sweat from the back of the head should slant at least slightly downward to promote flow of the sweat toward tube 2. In such case elastic portion 7 may be relatively short or may be positioned in the portion in contact with the forehead. Where it is desired to have sweat collected only off the back of the head, the front portion may comprise an ordinary type of headband material including absorbent material such as terry cloth.

Figure 9:
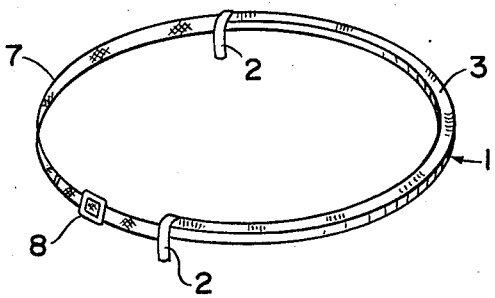
FIG. 9 is a perspective view of a modification of a headband in which the device for returning sweat to the mouth is omitted so that sweat is merely run off from the collecting groove.

FIG. 9 shows a modification in which the collected sweat is not returned to the runner's mouth but instead is merely allowed to run off through abbreviated tube 2 or merely through an opening at that point in the lower part of trough 3.

The groove or tube with slots or openings therein which collects the sweat may be referred to as a passageway.

Figure 4:
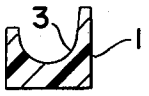
FIGS. 4, 5 and 6 are cross-sectional views of preferred headband construction having a collecting groove therein.
Figure 5:
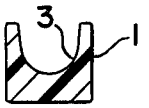
Figure 6:
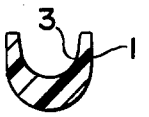

The headbands may be of various materials suitable for this purpose such as plastics, rubber, leather, etc., preferably of a non-absorbent nature. The cross-section of the headband may be circular, triangular, rectangular, etc., with a groove, gutter or trough provided to serve as described above. These are illustrated in FIGS. 4, 5 and 6, each of which shows groove 3 on the upper side of headband 1.

While certain features of this invention have been described in detail with respect to various embodiments thereof, it will of course be apparent that other modifications can be made within the spirit and scope of this invention and it is not intended to limit the invention to the exact details insofar as they are defined in the following claims.

The invention claimed is:

1. A headband assembly comprising (a) a continuous unbroken headband adapted to be fitted directly snugly against the head of the wearer, said headband having at least one passageway therein of fixed shape extending along a substantial portion of the length of said headband, said passageway being disposed in said headband so as to intercept and collect sweat running down the head of the wearer and (b) a receiving means coupled to said passageway for receiving the sweat collected in said passageway and adapted to transmit the collected sweat to the wearer's mouth, said receiving means comprising a tube leading into a grooved faceband slanting downward and forward, said grooved faceband connecting with and feeding into a lower tube adapted to extend to the wearer's mouth, said lower tube having an opening in the lower portion thereof whereby said collected sweat may enter the wearer's mouth.

2. A headband assembly comprising (a) a continuous unbroken headband adapted to be fitted directly snugly against the head of the wearer, said headband having at least one passageway therein of fixed shape extending along a substantial portion of the length of said headband, said passageway being disposed in said headband so as to intercept and collect sweat running down the head of the wearer and (b) a receiving means coupled to said passageway for receiving the sweat collected in said passageway and adapted to transmit the collected sweat to the wearer's mouth, said receiving means comprising a tube leading into a grooved faceband slanting downward and forward, said faceband being adapted to collect sweat from the wearer's face and being connected at the lower end thereof with a hollow mouthpiece adapted to be fitted into the wearer's mouth, said mouthpiece having an opening therein through which sweat delivered to the interior of said hollow mouthpiece may be admitted into the wearer's mouth.

3. The assembly of claim 2, in which said headband is adapted to collect sweat only from the forehead of the wearer.

4. The assembly of claim 2, in which said headband is adapted to collect sweat only from the back of the head of the wearer.

5. The assembly of claim 2, in which said headband is adapted to collect sweat from both the forehead and the back of the head of the wearer.

* * * * *